US008662885B2

(12) United States Patent
Roland et al.

(10) Patent No.: US 8,662,885 B2
(45) Date of Patent: Mar. 4, 2014

(54) METHOD AND APPARATUS FOR EMISSIONS DETECTION IN A COMBUSTION APPLIANCE

(75) Inventors: Marc W. Roland, Indianapolis, IN (US); Hall Virgil, Brownsburg, IN (US)

(73) Assignee: Carrier Corporation, Farmington, CT (US)

( * ) Notice: Subject to any disclaimer, the term of this patent is extended or adjusted under 35 U.S.C. 154(b) by 927 days.

(21) Appl. No.: 12/443,069

(22) PCT Filed: Oct. 30, 2006

(86) PCT No.: PCT/US2006/042280

§ 371 (c)(1),
(2), (4) Date: Mar. 26, 2009

(87) PCT Pub. No.: WO2008/054382

PCT Pub. Date: May 8, 2008

(65) Prior Publication Data

US 2010/0009304 A1 Jan. 14, 2010

(51) Int. Cl.
*F23N 5/24* (2006.01)

(52) U.S. Cl.
USPC ..... 431/76; 431/18; 431/78; 431/21; 110/193; 110/203; 126/116 A; 126/116 R; 126/99 A

(58) Field of Classification Search
USPC ..... 431/76, 78, 18, 21; 110/193, 203; 126/116 A, 116 R, 99 A
See application file for complete search history.

(56) References Cited

U.S. PATENT DOCUMENTS

| | | | | |
|---|---|---|---|---|
| 4,262,843 | A * | 4/1981 | Omori et al. | 236/15 C |
| 5,211,820 | A * | 5/1993 | Poor et al. | 205/784.5 |
| 5,589,627 | A | 12/1996 | Sutton | |
| 6,595,201 | B2 | 7/2003 | Garloch et al. | |
| 6,748,004 | B2 * | 6/2004 | Jepson | 373/8 |
| 2004/0191130 | A1 * | 9/2004 | Marek et al. | 422/109 |
| 2006/0114115 | A1 * | 6/2006 | Smith et al. | 340/634 |

* cited by examiner

*Primary Examiner* — Avinash Savani
(74) *Attorney, Agent, or Firm* — Cantor Colburn LLP

(57) ABSTRACT

A furnace system that generates heat by combustion is provided. The furnace system includes a sensor (100) that detects a gas concentration. The sensor is in communication with the flue gas (15). A controller is in communication with the sensor. The controller monitors the gas concentration and acts to control or deactivate the furnace.

19 Claims, 10 Drawing Sheets

METHOD AND APPARATUS FOR EMISSIONS DETECTION IN A COMBUSTION APPLIANCE

BACKGROUND OF THE INVENTION

1. Field of the Invention

This invention relates generally to furnaces and, more particularly, a method and apparatus for detecting incomplete combustion in a furnace.

2. Description of the Related Art

Generally, complete combustion is the reaction between a hydrocarbon and oxygen that results in the formation of water vapor and carbon dioxide to release heat. A combustion reaction in which carbon monoxide (CO) is formed from a hydrocarbon is incomplete combustion or partial combustion. Incomplete combustion occurs when there is an insufficient amount of oxygen to react with the hydrocarbon resulting in CO, a poisonous gas. CO is also formed from other factors such as quenching a combustion process. Furnace systems are designed to run the combustion reaction with an excess of oxygen so that complete combustion can take place and the maximum amount of heat may be released from the hydrocarbon fuel. Therefore, incomplete combustion is undesirable in a furnace system that uses combustion to generate heat. In addition, incomplete combustion can adversely affect the function of the furnace system, such as, for example, decreasing efficiency.

Currently, residential furnaces do not have a detection system for directly monitoring the concentration of carbon monoxide or other gasses present in combustion products due to feasibility including high cost. Pressure switches provide a mechanism to ensure proper airflow in furnaces. The pressure switches are only activated when the proper amount of airflow is reached. In an event the minimum amount of airflow is not reached the furnace shuts down. In the furnace system, the pressure switches, undesirably, only deactivate the furnace system if there is an air blockage or starvation of combustion air.

Commercially available sensors, generally, are not used in fuel-fired furnaces due to the high cost of the sensor technology. Newly developed CO sensors are smaller and less expensive so they are better suited in this regard. Oxygen, carbon dioxide and hydrocarbon gas sensors are also functional for the purposes of detecting incomplete combustion. Temperature in furnaces can cause sensor failure. Excessive temperatures, such as temperatures greater than about 550° F., can cause sensor damage and failure. Tubing or sample pumps may be used to remove sensors from harsh temperature and humidity conditions.

Accordingly, there is a need for an improvement in applying sensors that detect incomplete combustion in a furnace.

SUMMARY OF THE INVENTION

A furnace system that generates heat by combustion is provided. The furnace system includes a sensor that detects a gas concentration of a flue gas. The sensor is in communication with the flue gas. A controller is in communication with the sensor. The controller monitors the gas concentration. A baffle plate directs a first portion of the flue gas into contact with the sensor and a second portion of the flue gas in a direction away from the sensor. A draft safeguard switch port has a draft safeguard switch that selectively permits dilution air to enter the furnace system to mix with the first portion of the flue gas.

In another aspect, a furnace system that generates heat by combustion is also provided. The furnace system includes a tube that has a first end connected to the furnace system downstream of an outlet of a combustion air blower and a second end connected to the furnace system upstream of an inlet of the combustion air blower. An air bleed orifice is through the tube. A sensor detects a gas concentration. The sensor is in communication with flue gas. A controller is in communication with the sensor. The controller monitors the gas concentration.

A furnace system that performs combustion is further provided. The furnace system includes a tube having a first end connected to the furnace system downstream of an outlet of a combustion air blower and a second end connected to the furnace system upstream of an inlet of the combustion air blower. The tube has a length minimizing a heat transfer area of the tube in contact with a flue gas. A sensor detects a gas concentration. The sensor is in communication with a flue gas. A controller is in communication with the sensor. The controller monitors the gas concentration.

The sensor may be a gas sensor or detector that is selected from the group consisting of a metal oxide sensor, a mixed metal oxide sensor, an electrochemical sensor, an infrared sensor, a catalytic sensor, and any combination thereof. The sensor may have at least a portion in communication with the flue gas that recedes, extends into, or remains flush with a flue elbow. The baffle plate may connect to a flue elbow forming a baffle inlet between the baffle plate and the flue elbow upstream of the sensor and form a baffle outlet between the baffle plate and the flue elbow downstream of the sensor. The baffle plate and a flue elbow may have a volume therebetween. The baffle plate may create negative pressure in the volume by the Bernoulli effect. The sensor may be positioned upstream of the draft safeguard switch port relative to a flow of the flue gas. The dilution air may enter the furnace system so that the baffle plate directs a first portion of the dilution air away from the sensor and a second portion of the dilution air may be directed toward sensor. At least a portion of the dilution air may mix with a portion of flue gas. The controller may take a control action or deactivate the furnace system when a preselected gas concentration is detected by the sensor. The sensor may be redundant to or replace a pressure switch of the system. The sensor may be temperature dependent or thermally sensitive and may replace a blocked vent system.

The air bleed orifice may vent an air bleed stream into the tube. The air bleed orifice may be a metered orifice. The air bleed orifice may be adjacent the first end upstream of the sensor relative to a direction of a flue sample flow in the tube. The flue gas sample may mix with air from the air bleed prior to and during contact with the sensor. The combustion air blower may generate a lower pressure at the combustion air blower inlet relative to the combustion air blower outlet to create a vacuum in the tube. The vacuum may direct a flue gas sample past the sensor back into the furnace system. The sensor may be a gas sensor or detector selected from the group consisting of a metal oxide sensor, a mixed metal oxide sensor, an electrochemical sensor, an infrared sensor, a catalytic sensor, and any combination thereof. The controller may take control action or deactivate the furnace system when a preselected gas concentration is detected by the sensor.

The controller may deactivate the furnace system or take other corrective action when a preselected gas concentration is detected by the sensor. The length may be less than about 2.5 inches.

The above-described and other features and advantages of the present disclosure will be appreciated and understood by those skilled in the art from the following detailed description, drawings, and appended claims.

DETAILED DESCRIPTION OF THE INVENTION

Figure 1A:
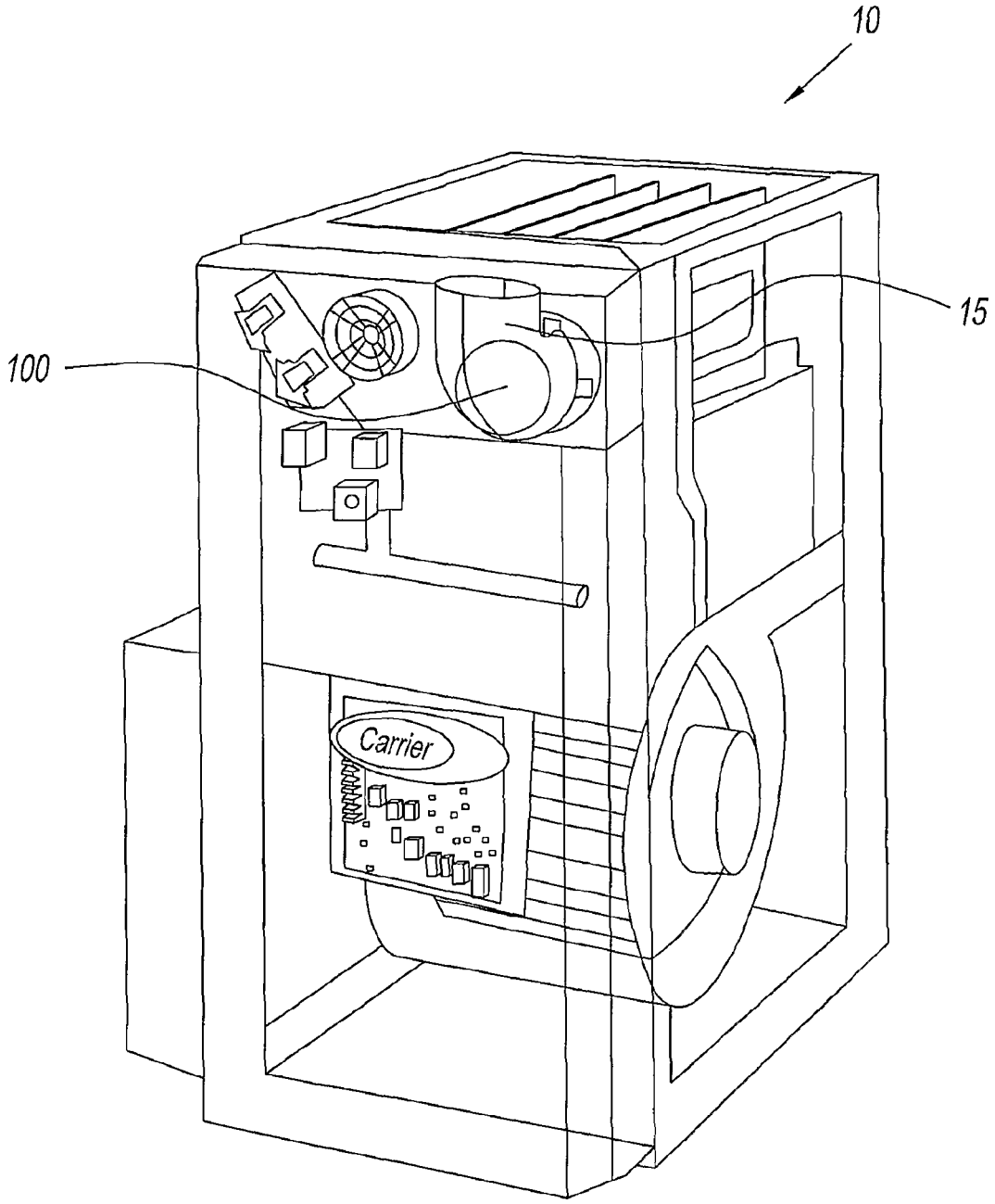
FIG. 1A is a front perspective view of a furnace system having a first exemplary embodiment of a sensor of the present invention.
Figure 1B:
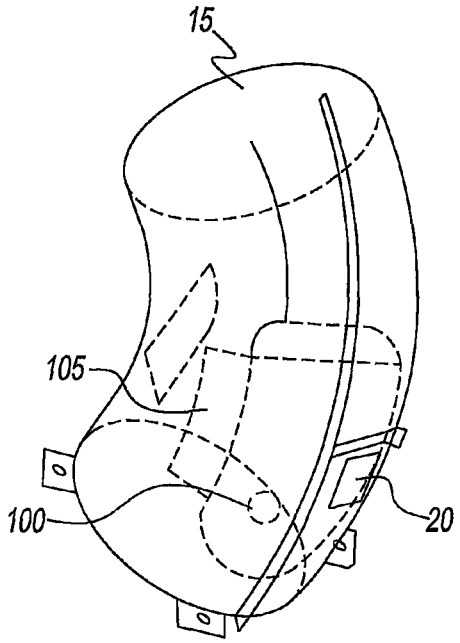
FIG. 1B schematically depicts an upward perspective view of a flue elbow with the sensor of FIG. 1A.

Referring now to FIGS. 1 through 4D, an exemplary embodiment of a sensor generally referred to by reference numeral 100 is illustrated. Sensor 100 detects gas concentration to aid in identifying an incomplete combustion event. Once the combustion event is identified by sensor 100, an appliance, such as, for example, a combustion appliance or an oil burning product may take a control action or shutdown to permit service to be performed or an external cause corrected.

Sensor 100 may be any sensor that detects flue gas concentration levels, such as, for example, a gas sensor or detector such as a metal oxide, mixed metal oxide, electrochemical, infrared or catalytic sensor. Sensor 100, preferably, is inexpensive as compared with a commercial analyzer.

Sensor 100 may be used in combination with a programmable machine and/or software, more preferably a computer program product having a computer useable signal with a computer readable code means embodied in the medium designed to monitor a signal from sensor 100. The programmable machine and/or software may take action as required, such as, for example, deactivating the gas combustion appliance or oil burning product to permit service to be performed or the external cause corrected when sensor 100 exceeds a predetermined concentration of gas. The gas constituent monitored may be the concentration of oxygen, carbon dioxide, carbon monoxide, or hydrocarbons. The predetermined concentration of gas, for example, carbon monoxide, may be greater than 50 parts per million (ppm). One example of a programmable machine is a CPU 500 that is described herein by way of example as a control processing unit. Of course, it is contemplated by the present disclosure for CPU 500 to include any programmable circuit, such as, but not limited to, computers, processors, microcontrollers, microcomputers, programmable logic controllers, application specific integrated circuits, and other programmable circuits. It is further contemplated by the present disclosure that CPU 500 is any number of control devices providing various types of control, e.g., centralized, distributed, redundant and/or remote control. This CPU could be connected to a furnace control board or remotely connected to a thermostat or other electronics. The CPU may be integral to the sensor itself.

Figure 1C:
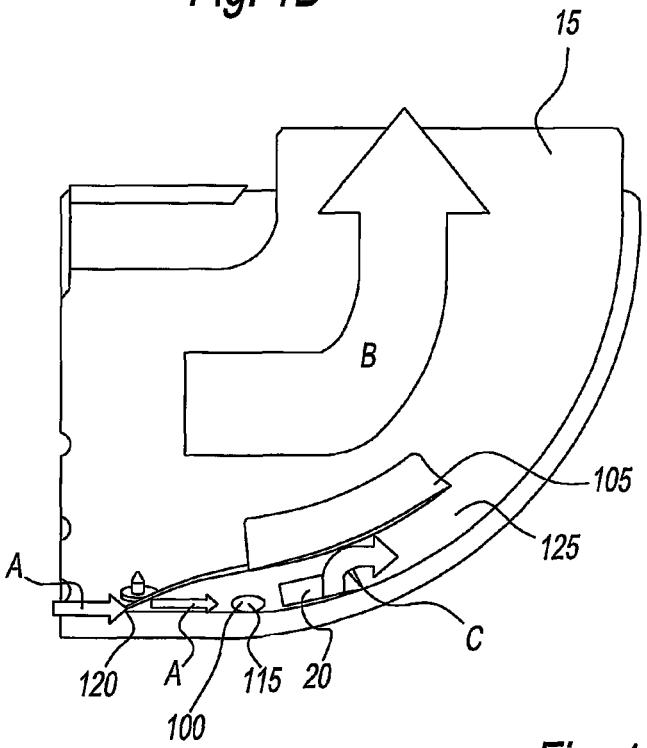
FIG. 1C schematically depicts a side cross-sectional view of a flue elbow with the sensor of FIG. 1A.
Figure 1D:
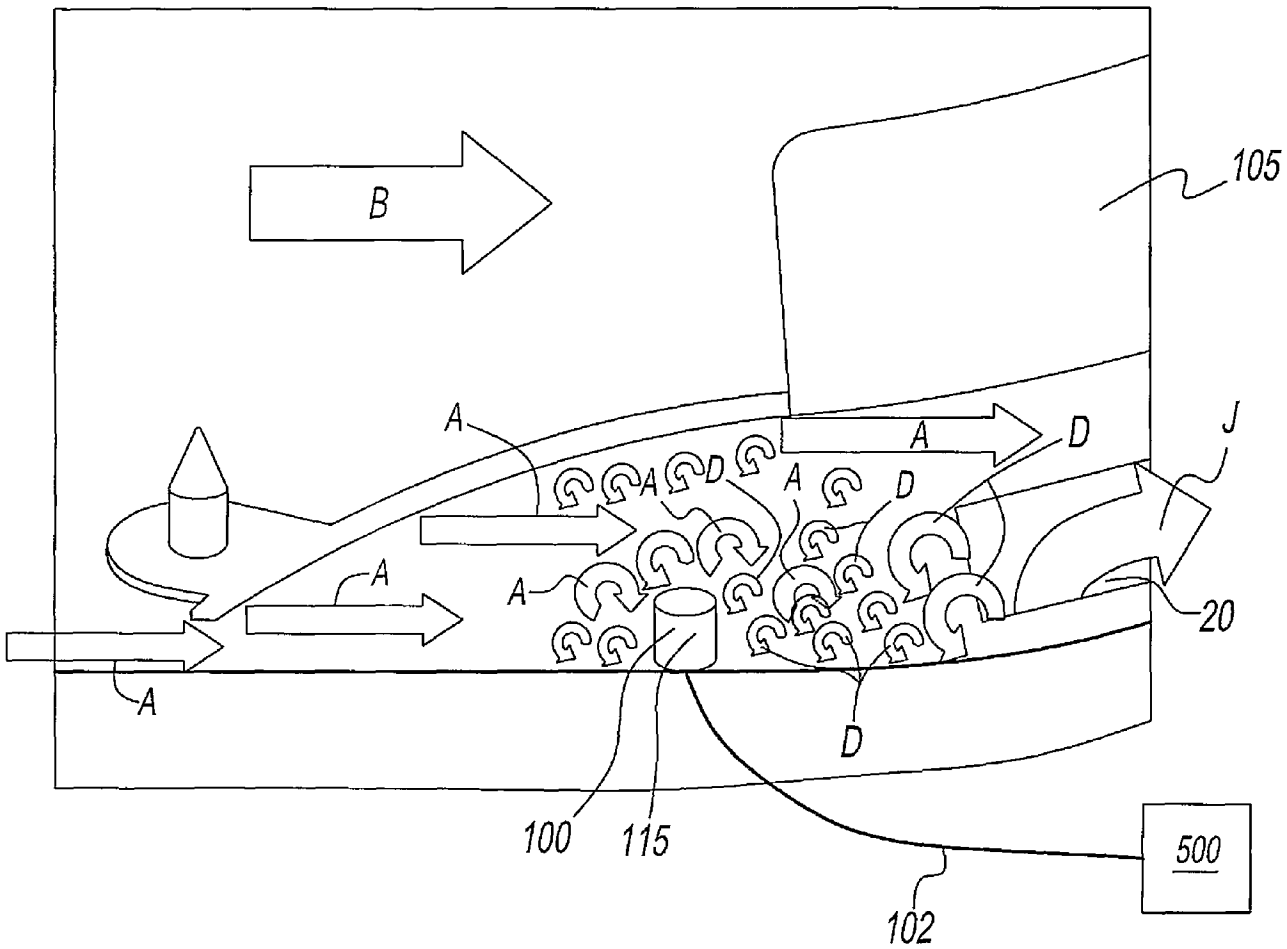
FIG. 1D schematically depicts a sectional side cross-sectional view of a flue elbow with the sensor of FIG. 1A.

Referring to FIGS. 1A through 1D, sensor 100 may be used in a furnace system 10 to detect flue gas concentration levels. Sensor 100 is located inside a flue elbow 15 of furnace system 10. However, sensor may be positioned anywhere in system 10 that is in communication with flue gas. Sensor 100 extends through a pipe wall of flue elbow 15 with a first end outside of flue elbow 15 and an opposite second end that extends into flue elbow 15. However, the sensor 100 may recede, extend into, or remain flush with the flue elbow 15. The sensor 100 is in communication with the flue gas. The first end of sensor 100 has a sensor signal wire 102 that connects to a CPU 500, as shown in FIG. 1D.

Sensor 100 may have a filter cap 115, as shown in FIGS. 1C and 1D. Filter cap 115 may act as an insulator to insulate sensor 100 from heat. Filter cap 115 minimizes or eliminates transfer of heat from the flue gas to sensor 100 to maintain sensor 100 within a desired operating temperature range. The particular type, including materials, dimensions and shape, of filter cap 115 that is utilized can vary according to the manufacturer, particular needs of sensor 100 and the environment created by furnace system 10. Filter cap 115, preferably, is non-metallic to provide insulation rather than conduction of heat, and more preferably, plastic. Insulating sensor 100 with filter cap 115 may extend the lifetime of sensor 100.

Baffle plate 105, preferably, extends from flue elbow 15. Baffle plate 105 directs flue gas from flue elbow 15 so that a portion of the flue gas passes below, and in contact with, sensor 100 as illustrated by arrows A in FIG. 1C. Baffle plate 105 directs a remainder of flue gas through elbow 15 in a direction away from sensor 100, as shown by reference arrow B in FIG. 1C. Baffle plate 105 may be connected to any portion of the system 10 in order to direct flue gas around sensor 100. Preferably, the portion of the flue gas that comes into contact with sensor 100 is smaller than the portion of the flue gas directed away from sensor 100. Baffle plate 105, preferably, connects to flue elbow 15 on opposite sides of sensor 100 and extends above sensor 100 to form an inlet 120 between baffle plate 105 and flue elbow 15 upstream of sensor 100 and an outlet 125 between baffle plate 105 and flue elbow 15 above or downstream of sensor 100, as illustrated in FIG. 1C. The baffle plate 105 directs flow of flue gas. The flow of the flue gas across the baffle plate 105 creates the conditions for the Bernoulli effect. The Bernoulli effect creates a negative pressure in a volume directly beneath baffle plate 105. The negative pressure induces the flue gas under baffle plate 105 into contact with sensor 100. Thus, sensor 100 may detect the gas concentration of the flue gas without the use of tubing or a sample pump by taking advantage of the negative pressure created by the Bernoulli effect.

Preferably, a draft safeguard switch permits dilution air to enter through a draft safeguard switch port 20 as illustrated by arrow C in FIG. 1C. Sensor 100, preferably, is positioned upstream of draft safeguard switch port 20 relative to the flow of the flue gas. The dilution air may enter flue elbow 15 between flue elbow 15 and baffle plate 105 so that a first portion of the dilution air is directed away from sensor 100, as illustrated by arrow J in FIG. 1D, and a second portion of dilution air is directed toward sensor 100, as illustrated by arrows D in FIG. 1D. As illustrated by arrows A and J between sensor 100, baffle plate 105, and flue elbow 15, the dilution air and flue gas mix. The dilution air of draft safeguard switch port 20 acts to reduce the sensor temperature surrounding sensor 100 and may extend the life-span of sensor 100 when compared with a sensor exposed to undiluted flue gas. Sensor 100 may also have a lowered humidity compared with a sensor exposed to undiluted flue gas as a result of the dilution air. The lower flue gas humidity created by the dilution air may also increase the life-span of sensor 100.

The location of sensor 100 inside flue elbow 15 near draft safeguard switch port 20 under the baffle plate 105 minimizes condensation by taking advantage of a flue gas temperature at that location and the dilution air entering flue elbow 15 through draft safeguard switch air port 20. Thus, sensor 100 may be directly exposed to the diluted flue gas inside flue elbow 15 at the operating temperature range that sensor 100 is able to reliably function and eliminates any need for a sample tube, separate or parallel gas circuit, sample pump, or other analogous path located outside of a flue gas path to transport a flue gas sample stream from the flue gas path to a sensor.

Sensor 100 may be temperature dependent and may be used to replace the blocked vent system. Temperature and humidity may be parameters detected by sensor 100. The temperature and humidity dependencies of sensor 100 can be taken advantage of to calculate a flue gas temperature around sensor 100 by CPU 500 or other control device. Upon sensor 100 detecting a predetermined temperature, the blocked vent system may be activated or deactivated.

Sensor 100 may also be used to replace or provide redundancy to the pressure switch. Currently the pressure switch is used to ensure a proper amount of combustion air is supplied to a combustion process. If too little combustion air is supplied to the combustion process, elevated flue gas carbon monoxide concentrations compared with typical operating conditions undesirably result. Alternatively, if too much combustion air is supplied, elevated carbon monoxide concentrations result, a gas concentration sensor would sense high concentrations of carbon monoxide or other gas and take control action or deactivate the furnace.

Figure 3A:
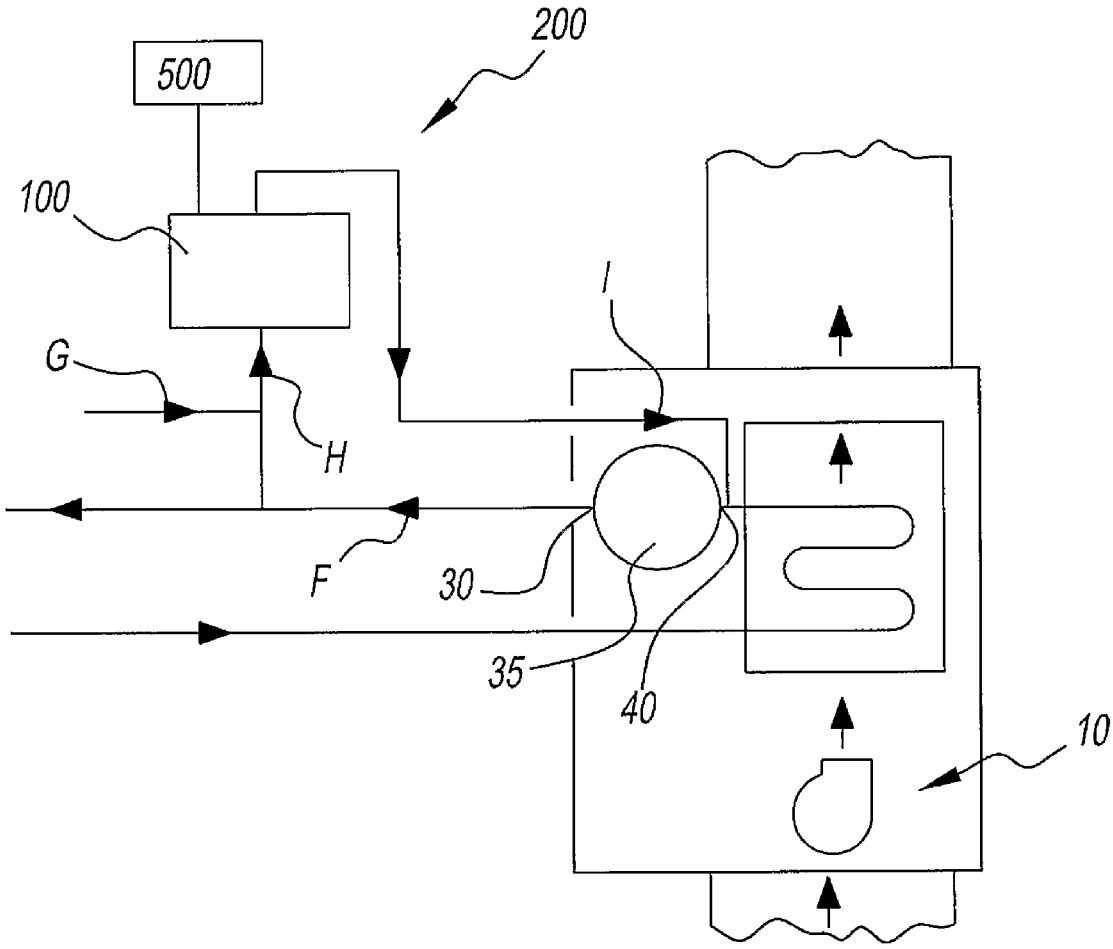
FIG. 3A schematically depicts the furnace system with a second exemplary embodiment of a sensor, utilizing an air bleed hole concept and tube to drive flow, reduce sample gas temperature and water vapor content.
Figure 3B:
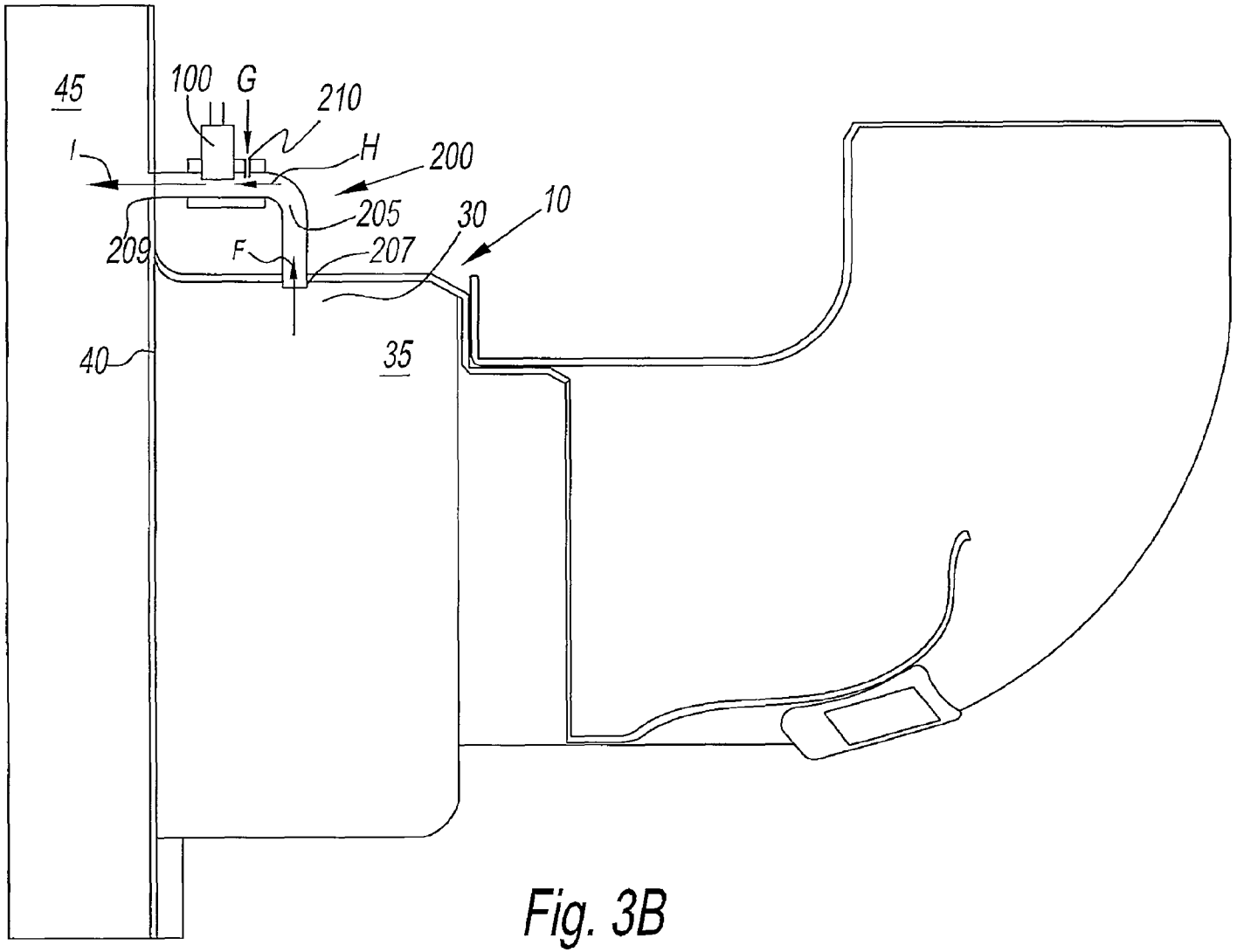
FIG. 3B is a side perspective view of the furnace with the sensor of FIG. 3A.

Referring now to FIGS. 3A and 3B, sensor 100 may be used with a small tube or separate or parallel gas circuit 200. Gas circuit 200 may have a sample tube 205. Sample tube 205 may have a first end 207 connected to a first combustion air blower outlet 30 of a flue gas blower or combustion air blower 35 of furnace system 10. Sample tube 205 may have a second end 209 opposite first end 207 connected to a combustion air blower inlet 40 of combustion air blower 35. Sample tube 205 may have an air bleed orifice 210. Air bleed orifice 210, preferably, is a metered orifice to control an inflow or bleed air.

The particular type, including materials, dimensions and shape, of sample tube 205 and air bleed orifice 210 that is utilized can vary according to the particular needs of sensor 100 and furnace system 10. A silicone tube one quarter inch in outside diameter is preferred but it could be made from any variety of materials such as copper, or stainless steel. Any diameter or shape may Uncork but a smaller diameter tube is preferred.

The combustion air blower 35 generates a lower pressure at combustion air blower inlet 40 relative to combustion air blower outlet 30, thus, creating a vacuum. The vacuum creates a direction of flow, as illustrated by arrow F, that directs a flue gas sample into sample tube 205 of gas circuit 200. An inflow or air bleed, as illustrated by arrow G, of air from outside of sample tube 205 may enter sample tube 205 through air bleed orifice 210. Air bleed orifice 210, preferably, is upstream, relative to the direction of flow illustrated by arrow F, of sensor 100 to mix the flue gas sample with air from the air bleed prior to and during contact with sensor 100. The flue gas sample flows in a direction shown by arrow H into contact with sensor 100. The vacuum created by combustion air blower 35 directs flue gas sample past sensor 100 back into furnace system 10, as shown by arrow I. Thus a gas sample pump, is not required to direct flow to sensor 100.

An air bleed airflow rate may be more controlled and less variable than other prior art flue gas dilution. The air from the airbleed that may mix with the flue gas may lower the humidity and temperature of the flue gas sample. Thus, the air bleed airflow functions to lower the sensor temperature and humidity compared to a sensor exposed to undiluted flue gas. The air bleed may also assist in preventing a condensate blockage in sample tube 205. The air bleed may maintain a small flow of air through sample tube 205 that evaporates and assists movement and removal of condensate water. If air bleed orifice 210 has a diameter that is precisely manufactured, an airflow rate into sample tube 205 can be quantified and proportions of the flue gas and air in sample tube 205 may be adjusted for optimal function of sensor 100. Sample tube 205 may also be insulated to maintain an average temperature of gases passing through sample tube 205 above the dew point temperature to further minimize condensate water.

Figure 2:
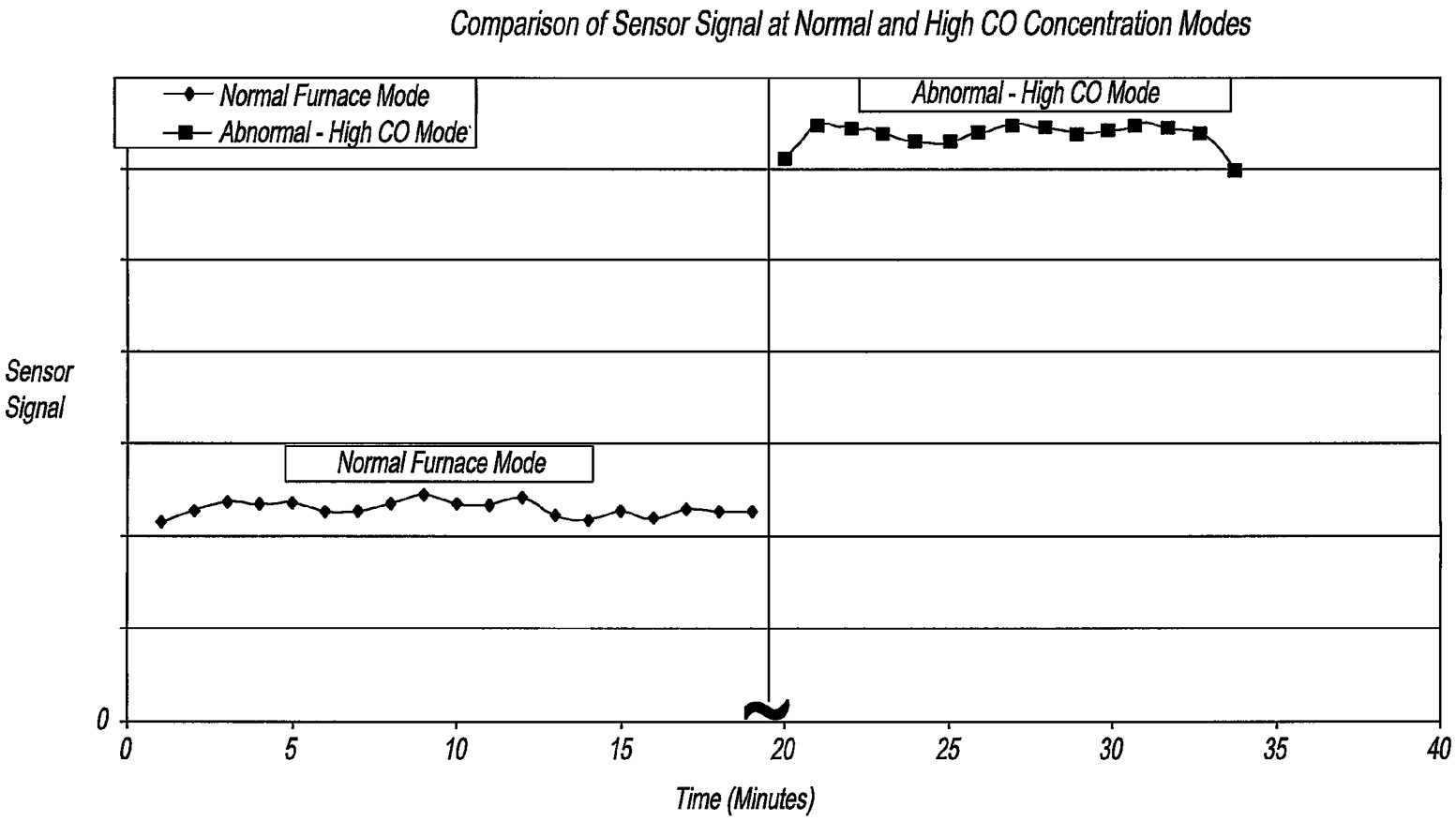
FIG. 2 is a graphical depiction of a comparison of a sensor signal when sampling furnace gas at normal and high carbon monoxide concentrations at the sensor of FIG. 1C, FIGS. 3A, and 4A.
Figure 4A:
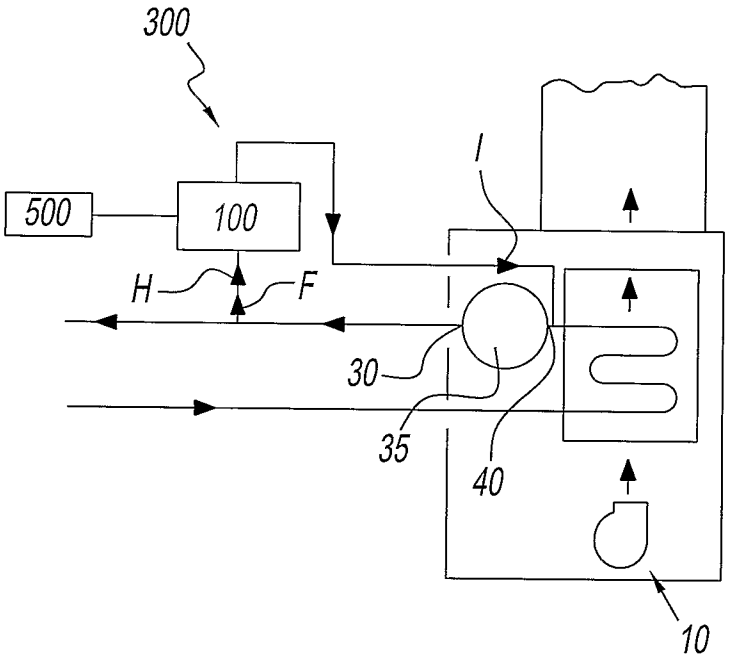
FIG. 4A schematically depicts the furnace system with a third exemplary embodiment of a sensor, utilizing a tube concept to reduce sensor temperature, and drive flow.
Figure 4B:
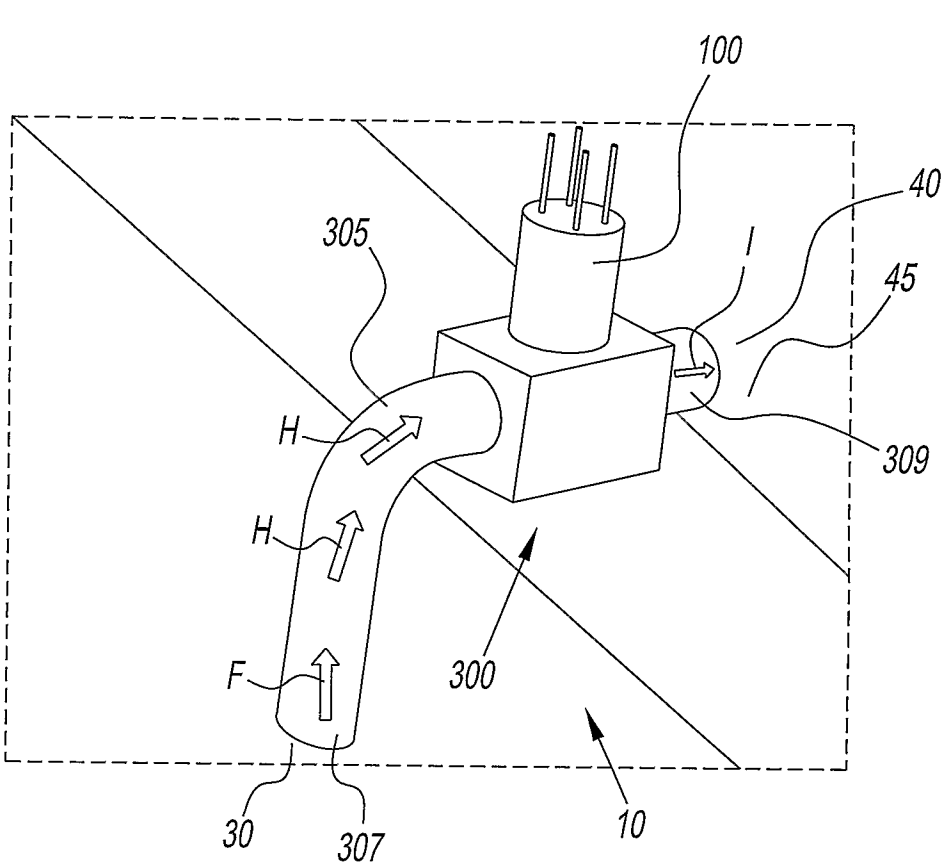
FIG. 4B schematically depicts a sectional side perspective view of the furnace system with the sensor of FIG. 4A.
Figure 4B:
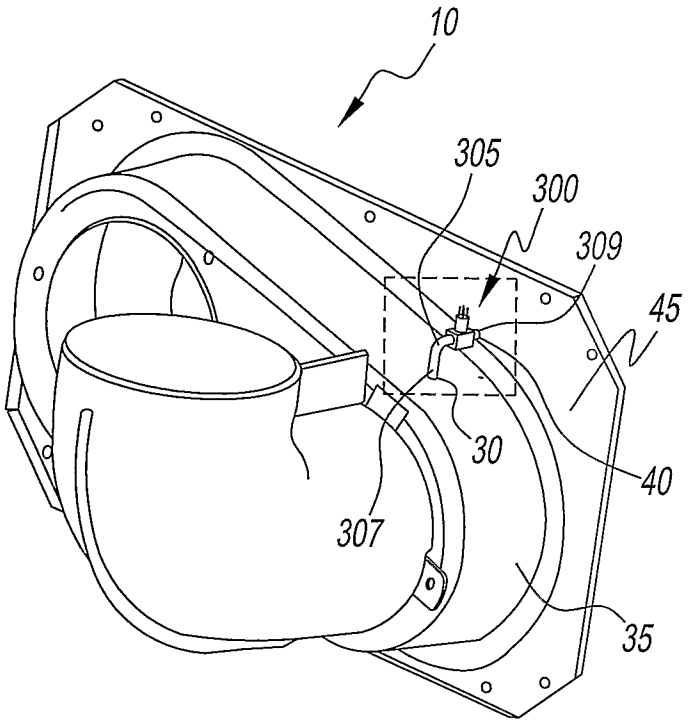
Figure 4C:
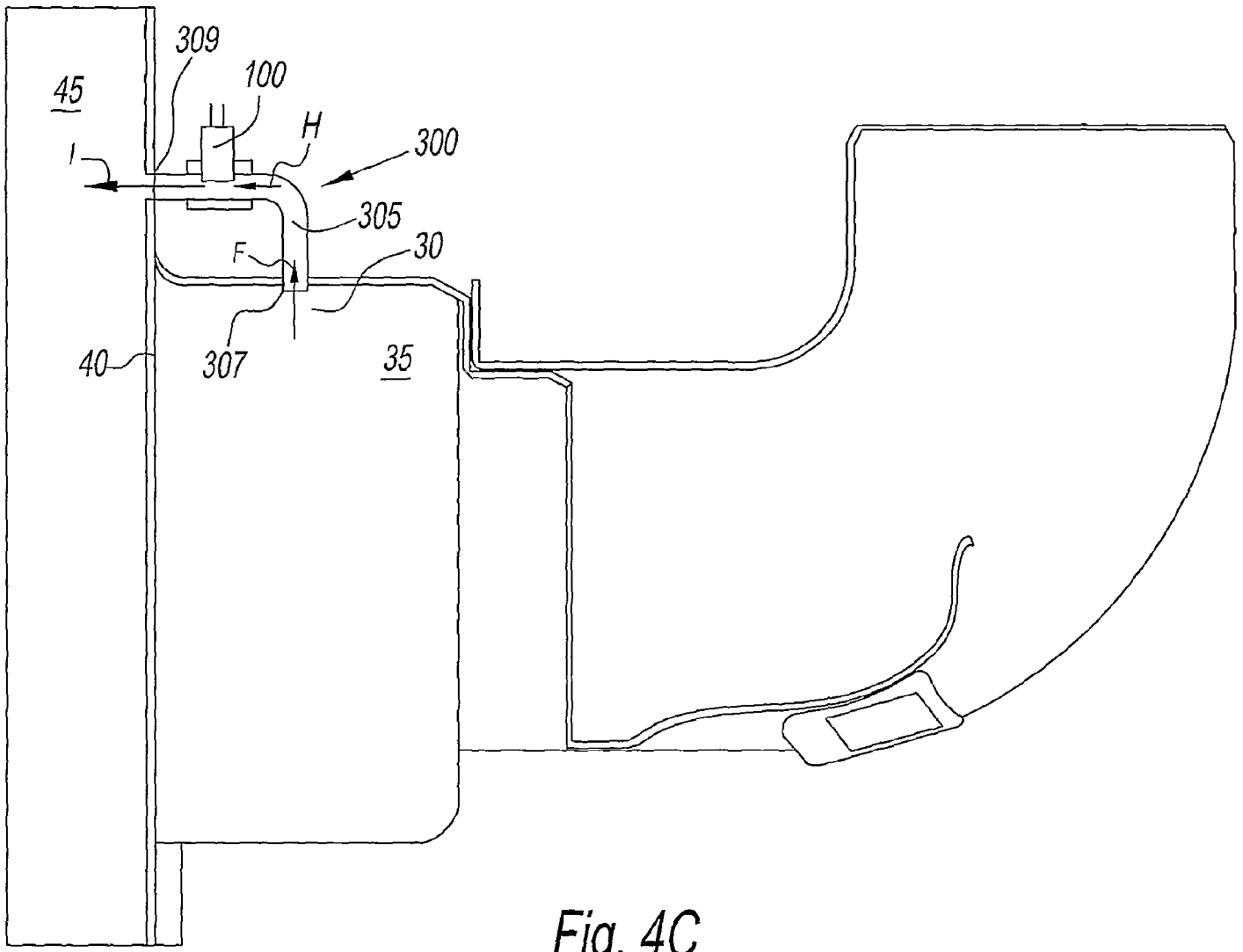
FIG. 4C schematically depicts a sectional side perspective view of the furnace system with the sensor of FIG. 4A.
Figure 4D:
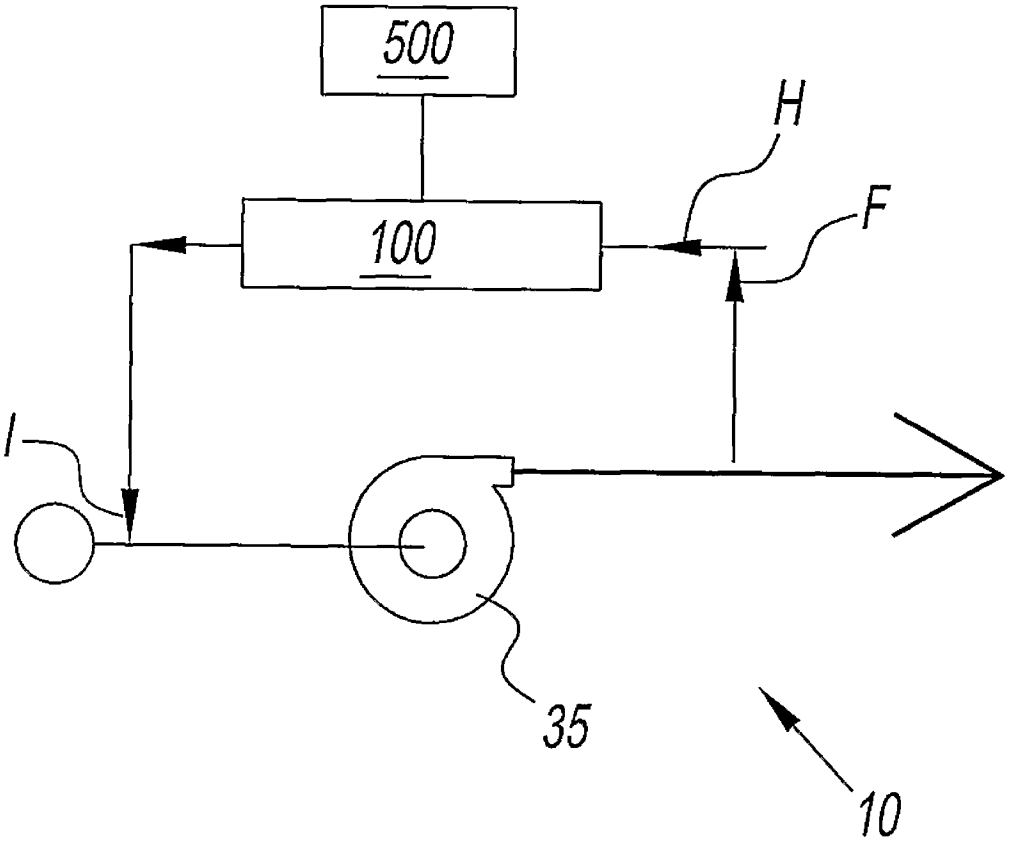
FIG. 4D schematically depicts the furnace system with the sensor of FIG. 4A.

FIG. 2 illustrates a graphical depiction of a comparison of a sensor signal when sampling furnace gas at normal and high carbon monoxide concentrations at sensor of FIG. 1C, FIGS. 3A, and 4A described below.

Referring now to FIGS. 4A through 4D, sensor 100 may be used with a gas circuit 300 that is similar to gas circuit 200 described above without air bleed orifice 210. Gas circuit 300 may have a short tube 305. Short tube 305 may have a first end 307 connected to combustion air blower outlet 30 of combustion air blower 35 of furnace system 10. Short tube 305 may have a second end 309 opposite first end 307 connected to a combustion air blower inlet 40 of combustion air blower 35.

The combustion air blower 35 generates a lower pressure at combustion air blower inlet 40 relative to combustion air blower outlet 30, thus, creating a vacuum. The vacuum creates a direction of flow, as illustrated by arrow F, that directs flue gas sample into short tube 305 of gas circuit 300. The flue gas sample flows in a direction shown by arrow H into contact with sensor 100. The vacuum created by combustion air blower 35 directs flue gas sample through short tube 305 past sensor 100 into a collector box 45 of furnace system 10, as shown by arrow I. Thus a sample pump is not required to direct flow to sensor 100. Short tube 305 reduces a probability of condensate blockage in the flue gas sample. If short tube 305 is preferably less than 2.5 inches, but may be shorter or longer, the heat transfer area of short tube 305 in contact with the flue gas sample is limited; and, thus, condensate blockage is limited. The gas concentration detected by sensor 100 can be used by CPU 500 to determine if the gas concentration exceeds a maximum permitted concentration, in which case CPU 500 may shut off fuel gas to furnace system 10 or take other appropriate action for proper combustion performance.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. A furnace system that generates heat by combustion, the furnace system comprising:

a sensor that detects a gas concentration of a flue gas, said sensor being positioned in a flue elbow in communication with said flue gas, said sensor generating a sensor signal, the sensor having a filter cap for providing insulation to said sensor;

a controller in communication with said sensor, said controller monitoring said gas concentration;

a baffle plate directing a first portion of said flue gas into contact with said sensor and a second portion of said flue gas in a direction away from said sensor; and a draft safeguard switch port located in the elbow having a draft safeguard switch that selectively permits dilution air to enter the furnace system to mix with said first portion of said flue gas;

wherein said baffle plate connects to a flue elbow forming a baffle inlet between said baffle plate and said flue elbow upstream of said sensor and forming a baffle outlet between said baffle plate and said flue elbow downstream of said sensor.

2. The system of claim 1, wherein said sensor is a gas sensor or detector selected from the group consisting of a metal oxide sensor, a mixed metal oxide sensor, an electrochemical sensor, an infrared sensor, a catalytic sensor, and any combination thereof.

3. The system of claim 1, wherein said sensor has at least a portion in communication with flue gas that recedes, extends into, or remains flush with a flue elbow.

4. The system of claim 1, wherein said baffle plate and a flue elbow have a volume therebetween.

5. The system of claim 1, wherein said sensor is positioned upstream of said draft safeguard switch port relative to a flow of said flue gas.

6. The system of claim 1, wherein said dilution air enters the furnace system so that said baffle plate directs a first portion of said dilution air away from said sensor and a second portion of said dilution air is directed toward sensor, and wherein at least said second portion of said dilution air mixes with said first portion of flue gas.

7. The system of claim 1, wherein said controller takes a control action or deactivates the furnace system when a preselected gas concentration is detected by said sensor.

8. The system of claim 1, wherein said sensor is redundant to or replaces a pressure switch of the system.

9. The system of claim 1, wherein said sensor is temperature dependent or thermally sensitive and replaces a blocked vent system.

10. A furnace system that generates heat by combustion, the furnace system comprising:

a tube having a first end connected to the furnace system downstream of an outlet of a combustion air blower and a second end connected to the furnace system upstream of an inlet of said combustion air blower;

an air bleed orifice through said tube;

a sensor that detects a gas concentration, said sensor being positioned in said tube in communication with flue gas, said sensor generating a sensor signal, wherein said sensor is a gas sensor or detector selected from the group consisting of a metal oxide sensor, a mixed metal oxide sensor, an electrochemical sensor, an infrared sensor, a catalytic sensor, and any combination thereof; and a controller in communication with said sensor, said controller receiving said sensor signal for monitoring said gas concentration.

11. The system of claim 10, wherein said air bleed orifice vents an air bleed stream into said tube.

12. The system of claim 10, wherein said air bleed orifice is a metered orifice.

13. The system of claim 10, wherein said air bleed orifice is adjacent said first end upstream of said sensor relative to a direction of a flue sample flow in said tube, and wherein said flue gas sample mixes with air from said air bleed prior to and during contact with said sensor.

14. The system of claim 10, wherein said combustion air blower generates a lower pressure at said combustion air blower inlet relative to said combustion air blower outlet to create a vacuum in said tube, and wherein said vacuum directs a flue gas sample past said sensor back into the furnace system.

15. The system of claim 10, wherein said sensor is a gas sensor or detector selected from the group consisting of a metal oxide sensor, a mixed metal oxide sensor, an electrochemical sensor, an infrared sensor, a catalytic sensor, and any combination thereof.

16. The system of claim 10, wherein said controller takes control action or deactivates the furnace system when a preselected gas concentration is detected by said sensor.

17. A furnace system that performs combustion, the furnace system comprising:

a tube having a first end connected to the furnace system downstream of an outlet of a combustion air blower and a second end connected to the furnace system upstream of an inlet of said combustion air blower, said tube having a length minimizing a heat transfer area of said tube in contact with a flue gas;

a sensor that detects a gas concentration, said sensor being positioned in said tube in communication with a flue gas, said sensor generating a sensor signal, wherein said sensor is a gas sensor or detector selected from the group consisting of a metal oxide sensor, a mixed metal oxide sensor, an electrochemical sensor, an infrared sensor, a catalytic sensor, and any combination thereof; and a controller in communication with said sensor, said controller receiving said sensor signal for monitoring said gas concentration.

18. The system of claim 17, wherein said controller deactivates the furnace system or takes other corrective action when a preselected gas concentration is detected by said sensor.

19. The furnace system of claim 1 wherein said baffle plate has a geometry that divides the flue gas into separate streams and permits said separate streams to rejoin downstream of said baffle plate.

* * * * *